US007293608B1

(12) United States Patent
Dudley et al.

(10) Patent No.: US 7,293,608 B1
(45) Date of Patent: Nov. 13, 2007

(54) LIQUID WELL STIMULATOR

(76) Inventors: Clifton M. Dudley, Hernia Hill Trail, Bellvue, CO (US) 80512; David R. Marr, Jr., 501 Wabash St., Fort Collins, CO (US) 80526

( * ) Notice: Subject to any disclaimer, the term of this patent is extended or adjusted under 35 U.S.C. 154(b) by 186 days.

(21) Appl. No.: 11/009,912

(22) Filed: Dec. 10, 2004

(51) Int. Cl.
*E21B 43/00* (2006.01)

(52) U.S. Cl. ..... 166/263; 166/370; 166/177.7

(58) Field of Classification Search ..... 166/263, 166/370, 177.7
See application file for complete search history.

(56) References Cited

U.S. PATENT DOCUMENTS 4,844,156 A * 7/1989 Hesh ..... 166/263
4,886,119 A 12/1989 Bernhardt et al.
5,147,530 A 9/1992 Chandler et al.
5,172,764 A 12/1992 Hajali et al.
5,452,765 A * 9/1995 Blanchard et al. ..... 166/370
5,988,284 A 11/1999 Dea
6,024,868 A 2/2000 Salotti et al.
6,146,104 A * 11/2000 Mastroianni et al. ..... 417/54
6,854,518 B1 * 2/2005 Senyard et al. ..... 166/372

* cited by examiner

*Primary Examiner*—William P Neuder
(74) *Attorney, Agent, or Firm*—McCarthy & Assoc.

(57) ABSTRACT

A stimulator device and associated method is provided for a subterranean liquid well comprising a pump adapted for selectively evacuating vapor from the borehole of the well above a liquid column in the borehole to opposingly impinge the liquid column to hydrostatically agitate a subterranean formation from which the liquid originates.

21 Claims, 5 Drawing Sheets

LIQUID WELL STIMULATOR

FIELD OF THE INVENTION

The embodiments of the present invention relate generally to the operation of liquid subterranean wells and more particularly without limitation to increasing the specific production capacity of a liquid well.

BACKGROUND

In liquid wells, such as water and oil wells, the well borehole is typically lined with a casing extending at its distal, or downhole, end to a depth into or below the saturated region in the subterranean formation. The distal end of the casing is perforated in order to permit the liquid to flow into the casing and rise to the static liquid level in the subterranean formation. For example, the liquid enters a water well and rises to the static aquifer level. This creates a pooling of the liquid as a liquid column in the casing which can be readily pumped to the surface either by a jet pump at the surface or by a submersible pump within the liquid column.

The liquid flows into the casing through one or more fissures, or veins, in the subterranean formation. The specific capacity of the well is directly related to the fissures' ability to replenish liquid into the casing at a rate equal to or greater than the rate at which the liquid is pumped out of the well. A well with inadequate liquid replenishment can be readily depleted. That is, even under ordinary usage, at best the specific capacity can be adversely affected by the reduced supply head pressure of the liquid column; at worst the liquid column level can drop below a pumpable level.

Drilling a well is a results-oriented endeavor, in that a driller cannot precisely determine the flow rate quality of fissures in the borehole area until functionally testing the completed well. An inadequately performing well might be abandoned and redrilled elsewhere, or might be worked-over to attempt to physically enlarge the fissures at the casing distal end.

However, even an adequately performing well can deteriorate with time to become depleted. Existing fissures can shrink and even close, due to the earth shifting and/or silting in as debris is carried with the liquid. In the event of a well deteriorating to an unusable performance, the well might be similarly abandoned for a new well nearby or it might be worked-over, which are relatively expensive and labor-intensive options.

What is needed is a quick, effective, and relatively inexpensive solution to stimulate an existing liquid well to increase its specific capacity. It is to this solution that the embodiments of the present invention are directed.

SUMMARY

As embodied herein and as claimed below, the embodiments of the present invention are directed to an apparatus and associated method for stimulating a liquid well in order to increase its specific capacity.

In some embodiments a stimulator device is provided for a subterranean liquid well comprising a vacuum pump adapted for selectively evacuating vapor from a borehole casing of the well above a liquid column in the casing. By alternatively raising and lowering the borehole vapor pressure, the liquid column hydrostatically agitates the subterranean formation from which the liquid originates. The vacuum pump can be a gas blower, and in some embodiments can be a positive displacement gas blower. Preferably, the well comprises a liquid pump adapted for selectively removing a portion of the liquid from the liquid column, wherein the stimulator device comprises a control energizing the vacuum pump in relation to an observed activity of the liquid pump. In some embodiments the control can comprise a flow meter in communication with the liquid removed by the liquid pump. In some embodiments the control can comprise a timer that energizes the vacuum pump for a predetermined interval in response to a predetermined activity level of the liquid pump. In some embodiments the control can comprise a pressure indicator for energizing the vacuum pump in response to a preselected pressure, such as borehole casing pressure.

In other embodiments a well is provided comprising a borehole casing defining at a distal end thereof a perforation for passing a liquid between a subterranean formation and a liquid column in the casing. A stimulator is adapted for selectively evacuating vapor from the casing above the liquid column to change a liquid column level within the casing and, in turn, change hydrostatic pressure in the subterranean formation. When the stimulator is deenergized, the liquid column level can be at a static level associated with a liquid level in the formation. When the stimulator is energized, the liquid column level can be lifted above the static level. In some embodiments the liquid column level can be lifted more than about ten feet above the static level. Preferably, the well comprises a liquid pump adapted for selectively removing a portion of the liquid from the liquid column. The stimulator can comprise a gas blower, and in some embodiments can comprise a positive displacement gas blower. The well can comprise a control that energizes the stimulator in relation to an observed activity level of the liquid pump. In some embodiments the control can comprise a flow meter in communication with the liquid removed by the liquid pump. In some embodiments the control can comprise a timer that energizes the stimulator for a predetermined interval in response to a preselected activity of the liquid pump.

In other embodiments a method is provided for stimulating a subterranean liquid well, comprising reducing the static pressure of vapor within a borehole casing of the well above a liquid column in the casing to lift the liquid column level; and subsequently increasing the reduced vapor pressure within the casing to lower the liquid column level. The lifting and lowering of the liquid column level hydrostatically agitates the subterranean formation from which the liquid originates. The reducing and increasing steps can be characterized by connecting the casing in fluid communication with a vacuum pump. The method can comprise, after the reducing step and before the increasing step, dwelling for a predetermined interval. The method can comprise pumping liquid from the liquid column independently of the reducing and increasing steps. The method can be characterized by performing the reducing step following an observed pumping step that has been performed for a predetermined interval. The method can be characterized by performing the reducing step for a predetermined interval. The method can comprise repeating the reducing and increasing steps for a predetermined number of occurrences. The method can be characterized by performing the reducing and increasing steps in response to an observed pressure, such as borehole casing pressure.

In other embodiments a stimulator device is provided for a subterranean liquid well having a borehole in fluid communication with a subterranean formation and having a column of liquid in the borehole, the stimulator device comprising a vacuum pump assembly adapted for alternatively evacuating and pressurizing the liquid column to hydrostatically agitate the subterranean formation.

These and various other features and advantages which characterize the claimed invention will become apparent upon reading the following detailed description and upon reviewing the associated drawings.

DESCRIPTION

Figure 1:
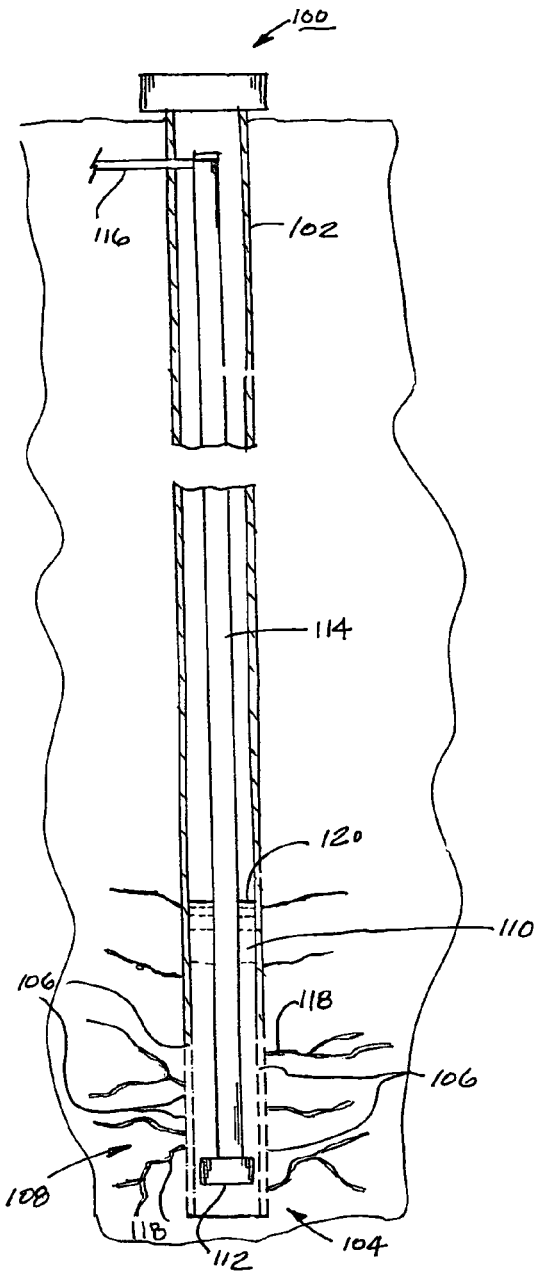
FIG. 1 RELATED ART
FIG. 1 is a diagrammatic illustration of a liquid well suited for application of the embodiments of the present invention.

FIG. 1 is a diagrammatical representation of a liquid well 100 that is illustrative of a type of well that is suited for stimulation aimed at increasing the specific capacity of the well in accordance with embodiments of the present invention. The liquid well 100 was formed by drilling a borehole into the subterranean earth and lining the borehole with a borehole casing 102. A distal end 104 of the borehole casing 102 defines a plurality of perforations 106 for passing a liquid between a subterranean formation 108 and a liquid column 110 within the casing 102.

A pump 112 is adapted for selectively removing the liquid 110 from the liquid column and delivering the liquid 110 through a vertical pipe 114 and ultimately to one or more supply pipes 116. When the pump 112 is deenergized (as depicted in FIG. 1), the liquid 110 will typically flow from one or more fissures, or veins, 118 within the subterranean formation, pass through the perforations 106, and accumulate in the casing 102 until the liquid column 110 in the casing 102 has a level 120 substantially equal to the static level of the associated saturated zone. For example, without limitation, in the case of a water well the liquid 110 will flow into the casing 102 until the liquid level 120 reaches the static aquifer level from which the liquid originated. When the pump 112 is energized, the liquid level 120 can drop below the static level if liquid in the casing 102 is not replenished at the same rate that the liquid is pumped out.

Figure 2:
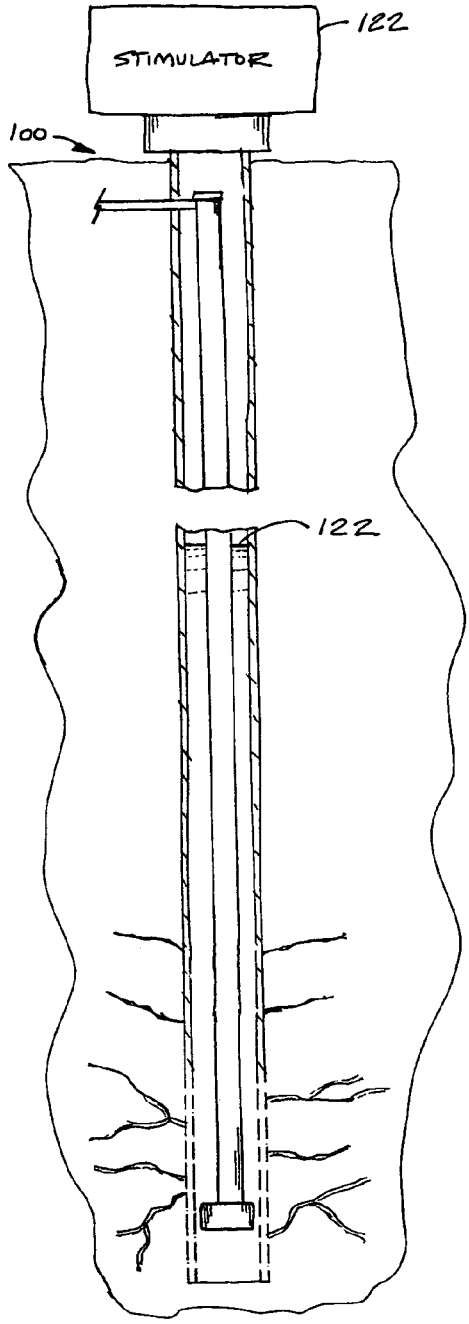
FIG. 2 is a diagrammatic illustration of the liquid well of FIG. 1 comprising a stimulator constructed and operated in accordance with embodiments of the present invention.

In FIG. 2, the well 100 is equipped with a stimulator device 122 constructed and used in accordance with the embodiments of the present invention to agitate the fissures 118. The stimulator 122 generally is adapted for selectively evacuating vapor from the casing 102 above the liquid column 110 to change the liquid level 120 (FIG. 1) to a raised liquid level 122. The term "raised" as used herein means generally to urge the liquid column 110 in a direction associated with the resultant direction of flow when the vapor in the casing 102 is evacuated. In the illustrative example of FIGS. 1 and 2, where the borehole casing 102 is substantially vertical, the liquid column 110 is raised substantially vertically. Conceivably, although not shown, the liquid column can be raised diagonally or travel horizontally where the borehole casing 102 is so disposed.

Figure 3:
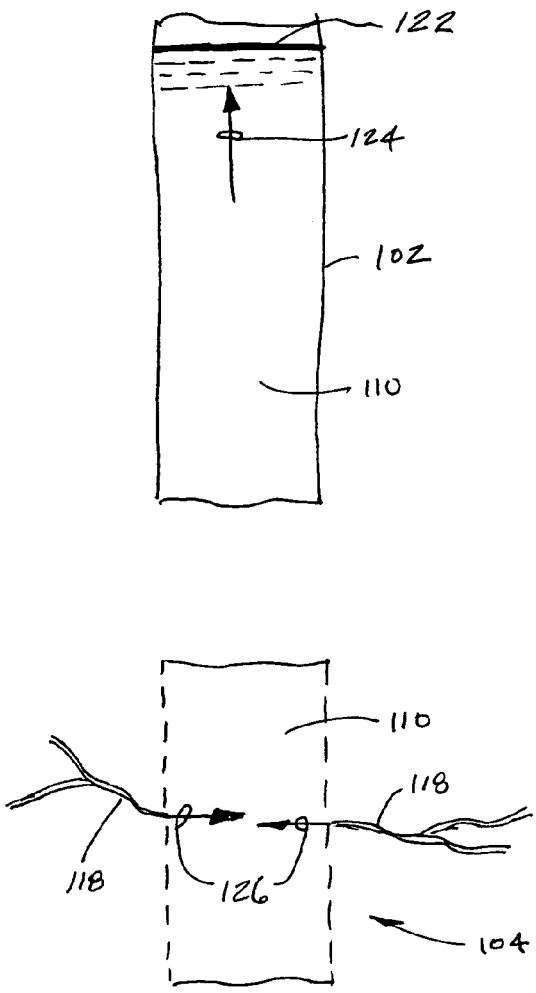
FIG. 3 is a diagrammatic illustration of the fissures in the subterranean formation being hydrostatically stimulated by injecting fluid into the casing during evacuation of the vapor above the liquid column.
Figure 4:
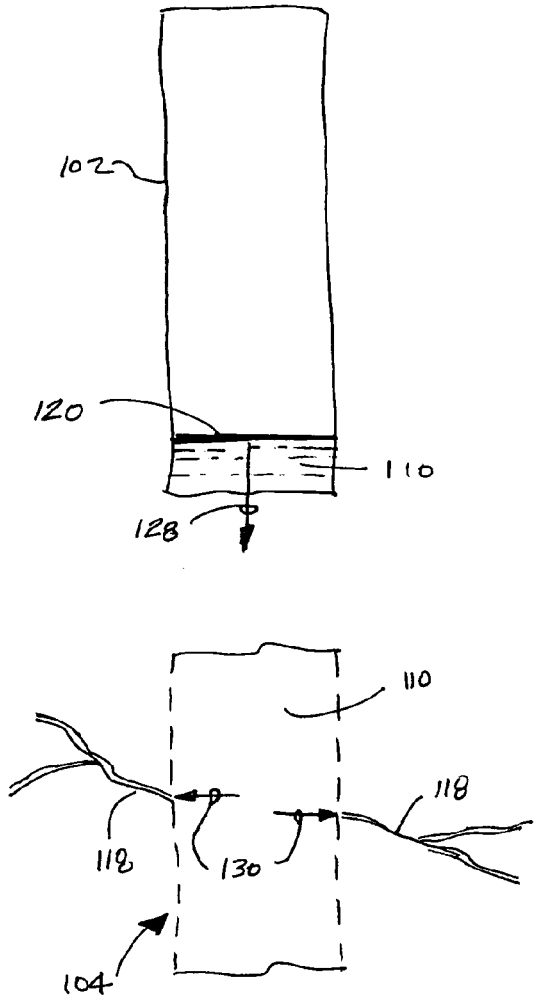
FIG. 4 is a diagrammatic illustration of the fissures in the subterranean formation being hydrostatically stimulated by backflushing fluid from the casing during release of the evacuation of the vapor above the liquid column.

FIGS. 3 and 4 illustrate enlarged portions of the well of FIG. 2 during stimulation. As the liquid level 120 is raised by force 124 impinging upon the liquid 110 upwardly (by example), the hydrostatic pressure on the fissures 118 from the standing liquid column 110 is reduced. This reduced pressure at the base of the liquid column 110 induces flow of liquid from the fissures 118 into the casing 102, as indicated by the inwardly directed radial arrows 126. Conversely, when the reduced pressure condition is released, the liquid column 110 falls by force 128 opposingly impinging upon the liquid column 110, such as the force of gravity in combination with any positive pressure in the casing 102. FIG. 4 illustrates the case where the falling liquid column 110 has returned to the liquid level 120 of FIG. 1. Upon release of the evacuation, the pressure above the liquid column 110 increases, and as the liquid column 110 lowers, reverse fluid flow is induced through the fissures 118, or backflushing, as indicated by the outwardly directed radial arrows 130.

The raising of the liquid column 110 from the level 120 (FIG. 1) to the level 122 (FIG. 3) facilitates increased flow rate through the fissures 118. The lowering of the liquid to the level 122 (FIG. 4) facilitates a backflushing of the fissures 118 to dislodge debris obstructing flow. By repeatedly raising and subsequently lowering the level of the liquid column 110, the fissures 118 are agitated by the reversing liquid flow therethrough, which acts to clear out and enlarge the fissures 118 in the subterranean formation 104.

Figure 5:
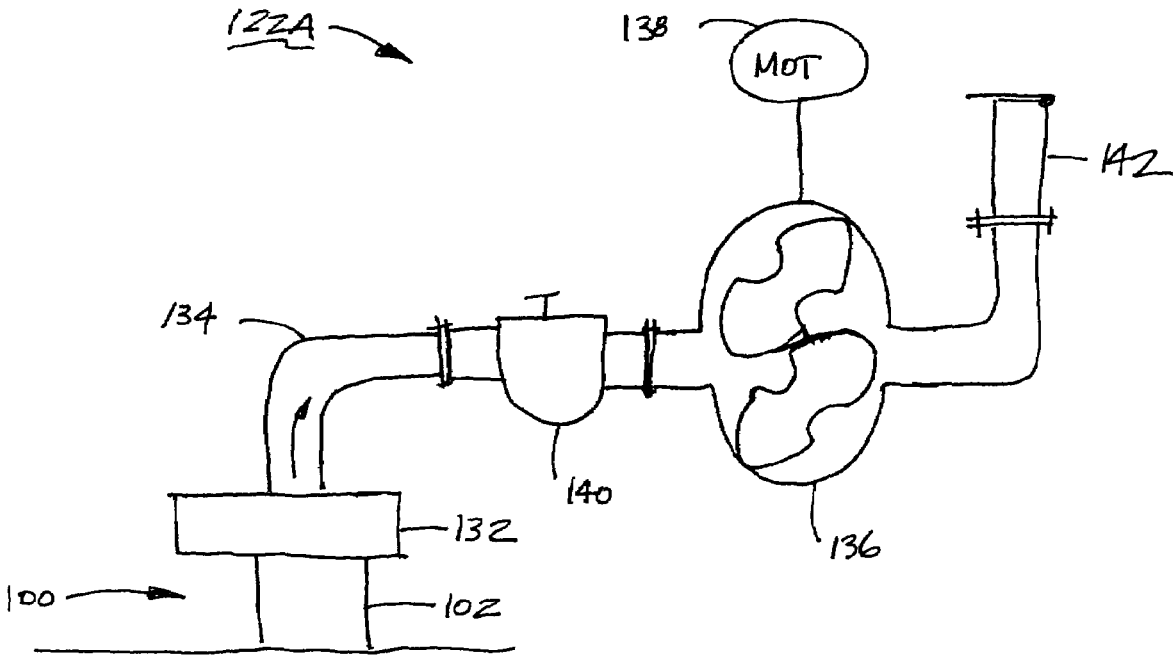
FIG. 5 is a diagrammatic illustration of a stimulator device constructed in accordance with embodiments of the present invention.

In some embodiments of the present invention a relatively strong vacuum pressure is desired to raise the level of the liquid column 110 several feet above the static level. Such a device can be used to rejuvenate a depleted well in a relatively short time. For example, without limitation, it has been determined that a depleted water well can be returned to a satisfactory operating state in about thirty minutes with a stimulator 122 that raises and subsequently lowers the liquid column 110 a distance of about 10 to 15 feet several times within the preselected short period of time. FIG. 5 illustrates a stimulator 122A constructed in accordance with embodiments of the present invention to produce a strong vacuum pressure for rejuvenating a well 100 in a short time. The stimulator 122A has an adaptive connector 132 that either connects to the existing well cap or replaces the well cap, in order to place an intake pipe 134 in fluid communication with the vapor above the liquid column 110 in the casing 102. A positive displacement pump 136 is powered by a motor 138 and connected to the intake pipe 134 to evacuate the casing 102 in order to raise the liquid column 110. The pump 136 is deenergized, and preferably a vent line (not shown) in the intake line 134 is opened to the ambient atmosphere, or to an appropriate vapor recovery unit operating at near atmospheric pressure where necessary, to rapidly release the vacuum in the casing 102 in order to lower the liquid column 110. Because of the close operating tolerances of the sealing surfaces of a positive displacement type pump 136, an air filter 140 is preferably disposed in the intake pipe 134 upstream of the pump 136 to protect the pump 136. Also, a filter or muffler 142 can be provided on the exhaust side of the pump 136.

In some embodiments it has been determined that a suitable pump 136 can be provided by using a Roots™ RAM™ series blower made by Dresser Industries of Houston, Tex. In conjunction, a suitable motor 138 can be provided by using a combustion engine manufactured by the Kohler Co. of Kohler, Wis. It was determined by experimentation that this combination power plant was capable of raising the liquid level in a typical water well as much as about 18 feet. Also, as opposed to shallow extraction type wells, the embodiments of the present invention are effective on both shallow and deep fluid wells, having demonstrated successful results on wells deeper than 5,000 feet.

In alternative equivalent embodiments of the present invention a relatively weak vacuum pressure is desired to raise and lower the level of the liquid column 110 to lesser heights in order to communicate and pulsate stimulation waves through the incompressible liquid 110 to the subterranean formation. Such a device can be used to maintain an acceptably producing well, or a rejuvenated well, for substantially an indefinite time.

Figure 6:
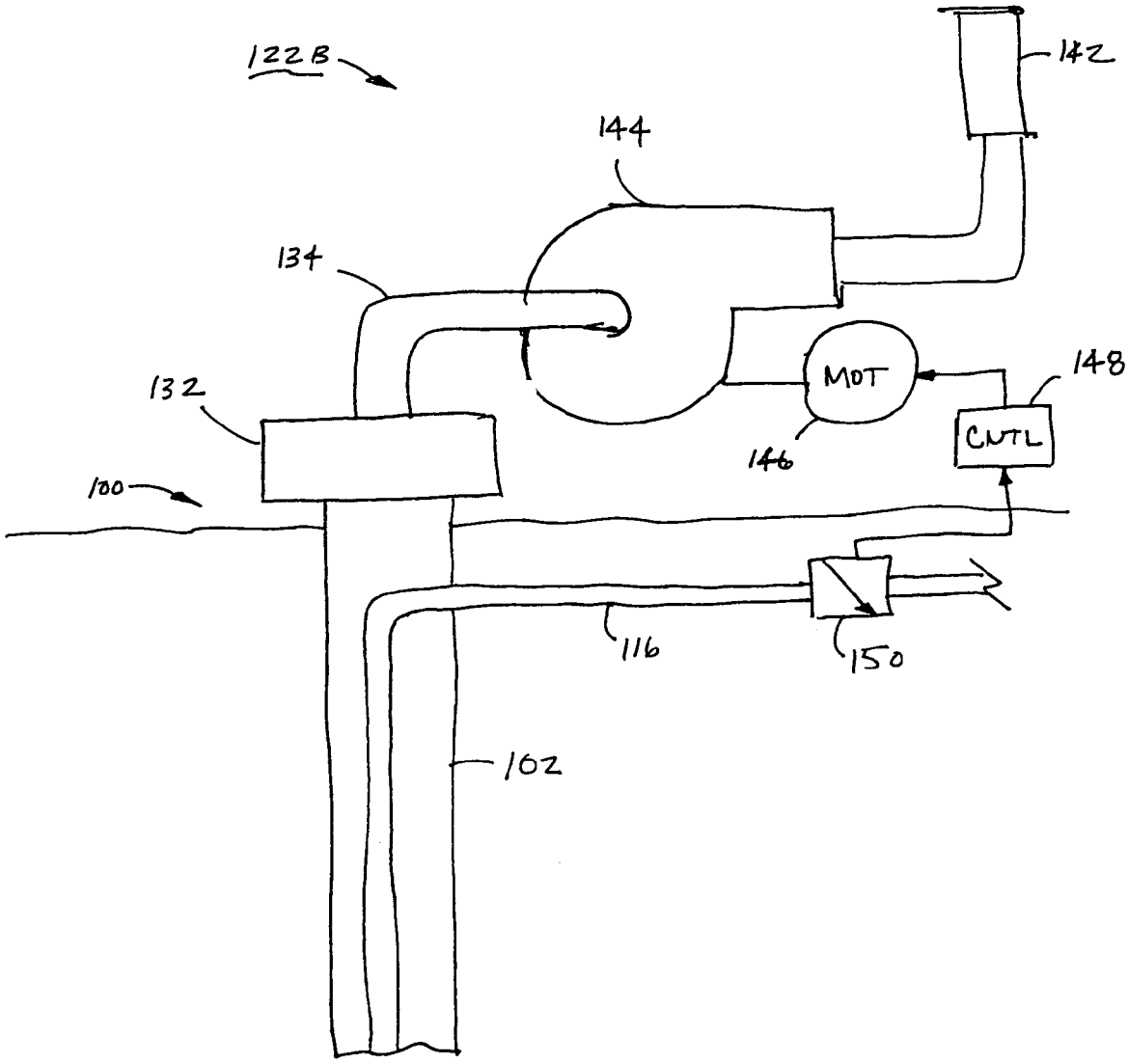
FIG. 6 is a diagrammatic illustration of a stimulator device constructed in accordance with alternative embodiments of the present invention.

FIG. 6 illustrates a stimulator 122B constructed in accordance with alternative embodiments of the present invention to produce a relatively weaker, or in other words a lesser vacuum pressure for maintaining a well 100 for an extended time. The stimulator 122B has an adaptive connector 132 and an intake pipe 134 as above. A vane pump 144 is energized by a motor 146 and connected to the intake pipe 134 to evacuate the casing 102. The pump 144 is deenergized by the motor 146 to release the vacuum in the casing 102.

In some embodiments it has been determined that a suitable pump 144 can be provided by using a sawdust type blower such as made by Suffolk Machinery Co. of Patchogue, N.Y. In conjunction, a suitable motor 146 can be provided by using a jet duty type electrical motor.

Because of the relatively extended time associated with using the stimulator 122B, it has been determined that intermittently, or periodically, cycling the stimulator 122B can be as effective as operating it continuously. For example, in some embodiments a controller 148 can be employed to activate the stimulator 122B after a predetermined interval, and for a predetermined time following activation. For example, the controller 148 might activate the stimulator 122B every 6 hours for thirty minutes of stimulation.

Through experimentation is has been determined to be particularly advantageous to associate the cycling of the stimulator 122B with the activity level of the well 100. That is, the optimal duty cycle for the stimulator 122B can be proportional to well activity. Accordingly, a flow meter 150 in the supply line 116 can provide an input signal to the controller 148 that activates the motor 146 and blower 144; this bases activation of the stimulator 122B in part on the activity level of the well 100. For example, without limitation, in this arrangement the controller 148 might activate the stimulator 122B for thirty minutes after every one-thousand gallons of liquid 110 has been pumped from the well 100.

Figure 7:
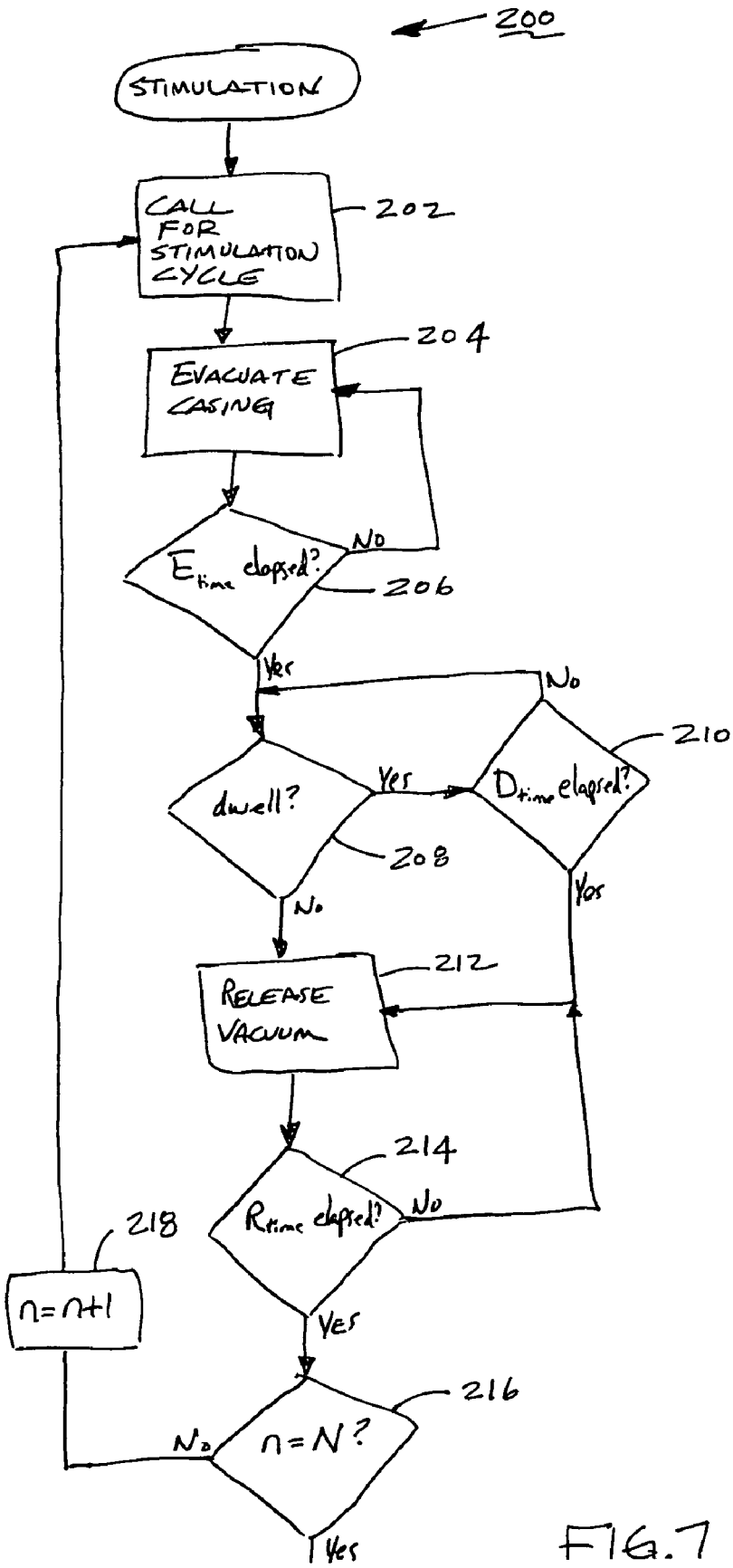
FIG. 7 is a flowchart illustrating steps for a method of STIMULATION in accordance with embodiments of the present invention.

FIG. 7 is a flowchart illustrating steps for practicing a STIMULATION method 200 in accordance with embodiments of the present invention. The method 200 begins with a call for a stimulation cycle in block 202. In some embodiments the call for stimulation 202 can be performed manually, as in switching on the stimulator 122A. In other embodiments the call for stimulation 202 can come from the controller 148 in response to a predetermined interval or an observed flow rate from the pump 112.

Upon a call for stimulation 202, control passes to block 204 where evacuation commences to reduce the static pressure of vapor in the casing 102 above the liquid column 110 to lift the level of the liquid column 110. As described, the evacuation is the result of energizing the vacuum pump 136, 144 of the respective stimulator 122A, 122B.

In decision block 206 it is determined whether a preselected evacuation time, $E_{time}$, has elapsed. The $E_{time}$ can be integral to the controller 148 or can be integrated into the motor 138, 146 circuitry. If the determination of block 206 is no, control returns to block 204 and evacuation continues; if yes, control passes to block 208. In block 208 it is determined whether a dwell time has been defined between the evacuation cycle and the release cycle. If the determination of block 208 is yes, control passes to block 210 where it is determined whether the preselected dwell time, $D_{time}$, has elapsed. If the determination of block 210 is no, control returns to block 208 for continued dwell. If the determination of block 208 is no, or if the determination of block 210 is yes, control passes to block 212.

In block 212 the reduced vapor pressure within the casing 102 is subsequently increased to lower the level of the liquid column 110. In some embodiments this is performed simply by deenergizing the vacuum pump 136, 144. In other embodiments, as discussed above, the liquid column can be lowered more effectively by also venting the intake pipe 134. In decision block 214 it is determined whether a preselected release time, $R_{time}$, has elapsed. If the determination of block 214 is no, then control passes to block 212 where the release continues; if yes, then control passes to block 216. In block 216 it is determined whether a preselected number of stimulation cycles of evacuation and subsequent release has been performed. For example, as discussed, the controller 148 can define a particular stimulation cycle 202 to include N stimulation cycles. If the determination of block 216 is no, then the number of performed cycles, n, is incremented in block 218 and control returns to block 202 for continued stimulation. If the determination of block 216 is yes, then the stimulation method 200 is completed, and the equipment is readied as necessary for the next call for stimulation cycle 202.

As discussed, in alternative equivalent embodiments the determination block 216 determines whether a preselected stimulation interval has elapsed. For example, without limitation, the call for stimulation 202 can define a preselected elapsed time T for performing the well 100 stimulation. Also, in equivalent alternative embodiments the apparatus and associated method can be controlled in terms of observed pressure, such as casing 102 pressure during stimulation.

Returning to FIG. 1, as discussed above, in some embodiments the stimulator 122 alternatively evacuates and releases the evacuation in the casing 102 above the liquid column 110 in order to transmit forces through the liquid column 110 to agitate the subterranean formation 108. In equivalent alternative embodiments the stimulator 122 can be used to evacuate and pressurize the casing 102 below the liquid column 110 to likewise agitate the subterranean formation 108. For example, the stimulator 122 can be connected to the supply line 116 so that liquid can be withdrawn from and pressurized to flow through the pump 112 at the downhole end of the casing 102. This alternative embodiment offers a solution where it is not desirable or feasible to evacuate the casing 102 above the liquid column 110.

It is to be understood that even though numerous characteristics and advantages of various embodiments of the present invention have been set forth in the foregoing description, together with details of the structures and function of various embodiments of the invention, this detailed description is illustrative only, and changes may be made in detail, especially in matters of structure and arrangements of parts within the principles of the present invention to the full extent indicated by the broad general meaning of the terms in which the appended claims are expressed. For example, the particular elements may vary depending on the particular application of the timing and or duration of the stimulation cycles without departing from the spirit and scope of the present invention.

What is claimed is:

1. A stimulator device for a subterranean liquid well having a borehole in fluid communication with a subterranean formation and having a column of liquid in the borehole, the stimulator device comprising a vacuum pump assembly adapted for selectively being energized to create an evacuation of vapor from the borehole above the liquid columnn to impart an upward force on the column of liquid and being deenergized to release the evacuation so that gravity imparts the only downward force on the column of liquid, the opposingly directed forces cyclically imparted against the liquid column to hydrostatically agitate the subterranean formation.

2. The device of claim 1 wherein the vacuum pump assembly is adapted for selectively raising and subsequently lowering the liquid column.

3. The device of claim 2 wherein the vacuum pump assembly is adapted for raising the liquid column above a static liquid level in the subterranean formation.

4. The device of claim 1 wherein the well comprises a liquid pump adapted for selectively removing a portion of the liquid from the liquid column, and wherein the device comprises a control energizing the vacuum pump assembly in relation to an observed activity of the liquid pump.

5. The device of claim 4 wherein the control comprises a flow meter in communication with the liquid removed by the liquid pump.

6. The device of claim 4 wherein the control comprises a timer that energizes the vacuum pump for a predetermined interval in response to a predetermined activity of the liquid pump.

7. A well comprising:

a borehole casing defining at a distal end thereof a perforation for passing a liquid between a subterranean formation and a liquid column in the casing; and a stimulator adapted for selectively being energized to create an evacuation of vapor from the casing above the liquid column to impart an upward force on the liquid column and being deenergized to release the evacuation so that gravity imparts the only downward force on the liquid column, the opposingly directed forces cyclically imparted on the liquid column to change a hydrostatic pressure in the subterranean formation.

8. The well of claim 7 comprising means for energizing the stimulator, and wherein when the stimulator is deenergized the liquid column is substantially at a static liquid level in the subterranean formation, and wherein when the stimulator is energized the liquid column is raised above the static liquid level.

9. The well of claim 8 wherein the liquid column is lifted more than about ten feet above the static liquid level.

10. The well of claim 9 wherein the stimulator comprises a positive displacement blower.

11. The well of claim 8 comprising a control that energizes the stimulator in relation to an observed activity of the liquid pump.

12. The well of claim 11 wherein the control comprises a flow meter in communication with the liquid removed by the liquid pump.

13. The well of claim 11 wherein the control comprises a timer that energizes the stimulator for a predetermined interval in response to a predetermined activity of the liquid pump.

14. A method for stimulating a subterranean liquid well comprising:

reducing the static pressure of vapor within a borehole casing of the well above a liquid column in the casing to create an evacuation imparting an upward force on the liquid column; and subsequently releasing the evacuation within the casing so that gravity imparts the only downward force on the liquid column, the upward and downward forces cyclically transmitted through the liquid column to hydrostatically agitate a subterranean formation from which the liquid originates.

15. The method of claim 14 wherein the reducing and increasing steps are characterized by connecting the casing in fluid communication with a vacuum pump.

16. The method of claim 14 comprising, after the reducing step and before the increasing step, dwelling for a predetermined interval.

17. The method of claim 14 comprising pumping liquid from the liquid column independently of the reducing and increasing steps.

18. The method of claim 17 characterized by performing the reducing step following an observed pumping step performed for a predetermined interval.

19. The method of claim 18 characterized by performing the reducing step for a predetermined interval.

20. The method of claim 14 comprising repeating the reducing and increasing steps for a predetermined number of occurrences.

21. A stimulator device for a subterranean liquid well having a borehole in fluid communication with a subterranean formation and having a column of liquid in the borehole, the stimulator device comprising a vacuum pump assembly adapted for being energized to create an evacuation of vapor from the borehole above the column of liquid to impart an upward force on the column of liquid and being deenergized to release the evacuation so that gravity imparts the onlv downward force on the column of liquid. the opposingly directed forces cyclically imparted against the liquid column to hydrostatically agitate the subterranean formation.

* * * * *